United States Patent [19]

Guimarin

[11] 4,016,782

[45] Apr. 12, 1977

[54] ADJUSTABLE RATCHET WRENCH

[76] Inventor: Henry L. Guimarin, Rte. 3, Box 337, Grapevine, Tex. 76051

[22] Filed: Sept. 12, 1975

[21] Appl. No.: 612,949

[52] U.S. Cl. ..... 81/63; 81/163

[51] Int. Cl.[2] ..... B25B 13/46

[58] Field of Search ..... 81/63, 163

[56] References Cited

UNITED STATES PATENTS

| | | | |
|---|---|---|---|
| 275,079 | 4/1883 | Reichling | 81/163 |
| 295,797 | 3/1884 | Osborn | 81/163 |
| 600,158 | 3/1898 | Miller | 81/163 |
| 1,135,929 | 4/1915 | Sands | 81/63 |

*Primary Examiner*—James L. Jones, Jr.
*Attorney, Agent, or Firm*—Giles C. Clegg, Jr.

[57] ABSTRACT

There is disclosed as the preferred embodiment of the invention an adjustable ratchet wrench including a disk member with ratchet teeth on its periphery and hub portions on each side of reduced diameter. A centrally disposed rectangular opening is provided in which a double acting lead screw is mounted. A pair of jaws are threadedly mounted on the lead screw of movement toward or away from each other dependent upon direction of rotation of the lead screw. A two piece body is provided which defines an elongated handle and two parallel, spaced apart members which terminate in a generally circular, enlarged ratchet holding head having circular openings in which the hub portions of the ratchet disk are received. A pall is provided for controlling the direction of ratchet movement.

1 Claim, 5 Drawing Figures

ADJUSTABLE RATCHET WRENCH

BACKGROUND OF THE INVENTION

The present invention relates to the tools, and more particularly to a ratchet wrench having jaws which are adjustable to accommodate different size heads of fasteners.

Ratchet wrenches have been known in the tool art for many years and substantial numbers of patents have issued upon different configurations of ratchet wrenches. However, in general the prior art ratchet wrenches are considered to be more mechanically complicated than the wrench of the present invention and hence more expensive to manufacture without providing as good a performance as the wrench of the present invention.

SUMMARY OF THE INVENTION

In accordance with the present invention, there is provided an improved, adjustable ratchet wrench which is characterized by simplicity of mechanical construction but which is durable and easy to use. The wrench of the present invention includes a body formed of two complimentary side pieces which define an elongated handle portion and two parallel, spaced apart members each terminating in a generally circular, enlarged, ratchet holding head. A circular ratchet disk member having a plurality of ratchet teeth about its periphery is provided with hub portions of reduced diameter which extend from opposite sides of the disk. Each of the ratchet holding heads include coaxial circular openings for receiving the hub portions of the ratchet disk, supporting the ratchet disk member for rotation. The ratchet disk member is preferably made of two complimentary parts in order to facilitate the mounting of a double acting lead screw for rotation in indentations formed interiorily of the ratchet disk. The ratchet disk includes a centrally disposed rectangular opening for receiving the double acting lead screw and a pair of opposed jaw members are threadedly mounted upon the lead screw for movement selectively toward and away from each other dependent upon the direction of the rotation of the lead screw. Opposed faces of the jaw members include two obliquely angled planes defining a spread V shape facilitating the use of the wrench of the present invention on fastener heads of both square and hexagonal configuration. A pawl is provided for controlling the direction the ratchet disk member is permitted to rotate.

DESCRIPTION OF THE DRAWINGS

Many objects and advantages of the invention will become apparent to those skilled in the art as a detailed description of a preferred embodiment of the invention unfolds in conjunction with the appended drawings wherein like reference numerals denote like parts and in which.

DETAILED DESCRIPTION

Figure 1:
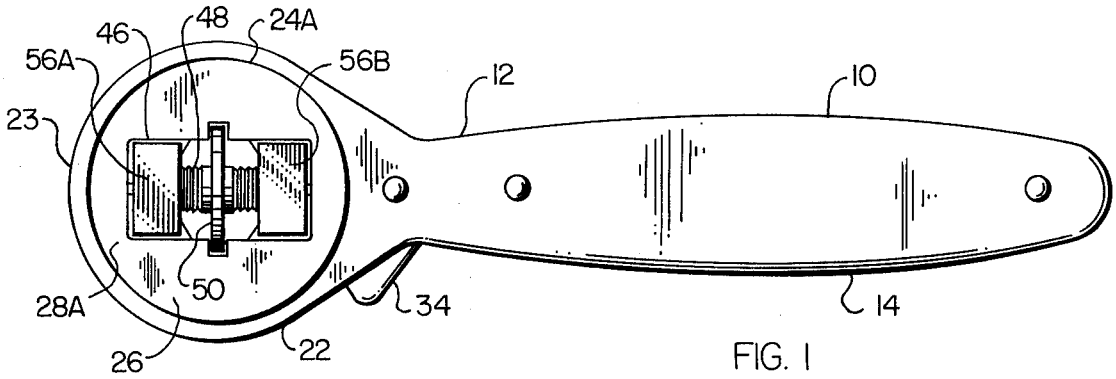
FIG. 1 is a plan view showing the rear side of a ratchet wrench in accord with the preferred embodiment of the invention.
Figure 2:
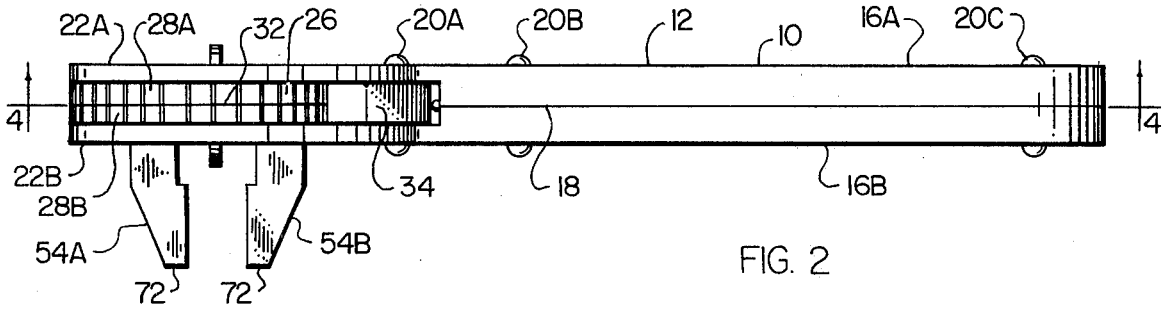
FIG. 2 is a side elevation view of the wrench.

Referring now to the drawings, the wrench of the present invention is denoted generally by the reference numeral 10. It can be seen to include a main body 12 defining a handle 14. As best shown in FIG. 2 of the drawings, the body 12 is formed of two members 16A and 16B which are connected along parting line 18 and held fixed together by rivets 20A, 20B and 20C. When the members 16A and 16B are assembled as shown in FIG. 2, the body includes two parallel spaced apart members 22A and 22B which terminate in a generally circular, enlarged ratchet holding head 23 with each of the members 22A and 22B having apertures 24A and 24B formed therein for receiving for rotational movement a ratchet member 26. Pawl 34 is provided for controlling the direction in which the ratchet member 26 can rotate relative to the body 12 of the wrench.

Figure 4:
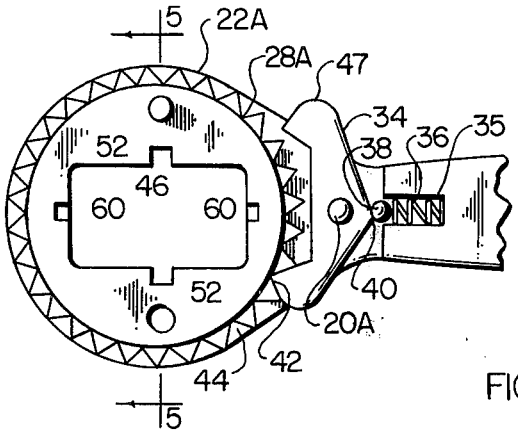
FIG. 4 is a view generally taken along line 4—4 of FIG. 2, but with wrench jaws and adjustment mechanism deleted and a ratchet control pawl arrangement shown in plan rather than in cross section.

FIG. 4 of the drawings illustrates the assembly and operation of the pawl and related elements. Each of the members 16A and 16B includes a recess 35 which is semicircular in cross section and which form, when members 16A and 16B are placed together, a recess circular in cross section for receiving spring 36 which biases a ball 38 against end 40 of the generally triangular shaped pawl 34. The pawl 34 is mounted for pivotal movement about the rivet 20A. When the pawl is positioned as shown, it will permit rotation of the ratchet in the clockwise direction as viewed in FIG. 4, with the end 42 of the pawl bearing against the teeth 44 of the ratchet to prevent movement in the opposite direction. As is conventional with such pawls, if pressure is applied against the side of the pawl from which end 46 extends, the pawl will pivot causing the ball 38 to bear on a different side of the end 40 biasing end 47 into contact the teeth 44 on the ratchet disk, permitting rotation only in the counter clockwise direction.

The ratchet member 26 is preferably formed of two complimentary disks 28A and 28B which meet along parting line 32 and are held together by members 22A and 22B. A rectangular shaped opening 46 is formed in the member 26. A double acting lead screw 48 is rotatably mounted within the opening 46 and adapted to be driven by an integral thumb wheel 50. Jaws 54A and 54B of the wrench include base portions 56A and 56B respectively having threaded holes there through which mate with the threads on the lead screw for adjustment of the jaws relative to one another.

Figure 3:
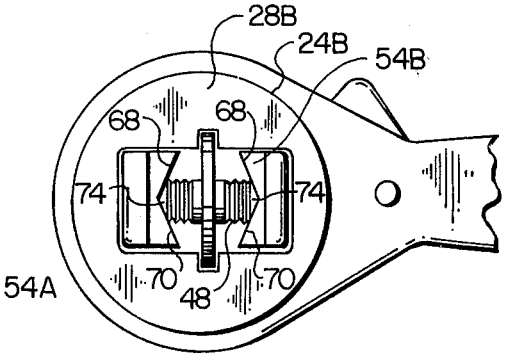
FIG. 3 is a partial plan view of the front side of the wrench.

As is best seen in FIG. 3 of the drawings, the opposed faces of the jaw members 54A and 54B each include two obliquely angles planes 68 and 70 defining a spread V shape extending from the free end 72 of each of the jaw members a limited distance determined by a face 74 normal to the faces of 68 and 70. Provision of the face 74 prevents a fastener, such as a bolt head, which the wrench is engaging interfering with the operation of the thumb wheel 50. Provision of the spread V configuration of the jaw members permits use of the wrench on either square or hexagonal fastener heads.

Figure 5:
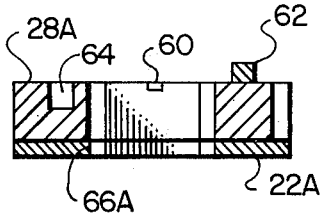
FIG. 5 is a cross sectional view taken along line 5—5 of FIG. 4.

The structure of the complimentary disk 28A and 28B can best be seen with respect to FIGS. 4 and 5 of the drawings. Thus, each of the complimentary disks include a pair of opposed slots 52 extending from the opening 46 for receiving the thumb wheel 50. In addition, a pair of opposed notches 60 are provided along a diameter which, when the two complimentary disks are placed in opposing relationship, form a recess for receiving reduced diameter end portions of the thumb lead screw 48 supporting the lead screw for rotational movement. Each of the disks also include a pin 62 and a blind hole 64. When the complimentary disks are assembled, the pin 62 of one of the disk is received within the blind hole 64 of the other disk for the purpose of preventing rotation of one of the disks relative to the other. The portion of each of the disks on which the ratchet teeth 44 are formed are suitably of approximately the same diameter as the diameter of the circular portion of the ratchet holding head 23, with each of the disks including a hub portion 66 of reduced diameter adapted to be received in the aperture 24 of the associated member 22.

From the foregoing, it can be seen that there is provided a ratchet wrench comprising only ten parts and three fasteners. Assembly of the wrench is quite simple in that it is only necessary to position the lead screw with the jaws mounted thereon on one of the disk members 28 with the reduced end portions of the lead screw positioned in the opposed notches 60. The second disk member is then laid over the first disk member with the pin 62 of each disk member inserted in the blind hole 64 of the other disk member. The resultant disk assembly is then placed into the aperture 24 with the reduced diameter hub portion 66 of one disk extending into the aperture 24. The fastener 22A can then be positioned in the appropriate hole of the member 16 and the pawl 34, spring 36, and ball 38 positioned as shown in FIG. 4. The remaining member 16 is then positioned similarly with respect to the disk assembly and pawl assembly and held together by the three fasteners. The simplicity of construction provides improved reliability. The structure of the ratchet disk and handle members such that they can be readily formed of sintered metal providing further manufacturing economies and a structure characterized by great physical strength.

Although the invention has been described with regard to a particular preferred embodiment thereof, changes and modifications will become apparent to those skilled in the art in view of the foregoing description and the invention is intended to be limited only as defined in the claims.

What is claimed is:

1. An improved adjustable ratchet wrench comprising:

a body formed of two complementary side pieces and defining an elongated handle portion and two parallel, spaced apart members each terminating in a generally circular enlarged ratchet holding head;

a circular ratchet member having a plurality of ratchet teeth about its periphery and hub portions of reduced diameter extending from opposing sides;

each of said ratchet holding heads including co-axial circular openings receiving one of the hub portions of said ratchet member and supporting said ratchet member for rotation;

a generally triangular shaped pawl member mounted between said spread apart members and pivotal between first and second positions in which first and second abutments selectively engage said ratchet teeth to selectively control the direction in which said ratchet member can be rotated;

spring means co-operatively associated with a third abutment for biasing said pawl member into said first and second positions;

a double acting lead screw having an intergal thumb wheel said ratchet member including a centrally disposed rectangular opening for receiving said double acting lead screw and means for supporting said lead screw at its ends for rotation about an axis coinciding with a diameter of said ratchet disk;

said ratchet disk including two complimentary disk portions each including an outer rim with ratchet teeth formed thereon, one said hub portions, a pair of opposed notches positioned along a first diameter of the disk defining said means for supporting said lead screw, a pair of opposed slots positioned along a second diameter of said disk normal to said first diameter for receiving said thumb wheel and means effective when the disk portions are positioned in opposed relationship for preventing rotation of one disk relative to the other;

a pair of opposed jaw members each having a threaded base and carried by said lead screw for movement selectively toward and away from each other dependent upon the direction of rotation of the lead screw;

opposed faces of said jaw members including two obliquely angled planes defining a spread V shape extending from the free end of the jaw member toward said base a limited distance.

* * * * *